US007938400B2

(12) United States Patent
Kakimoto et al.

(10) Patent No.: US 7,938,400 B2
(45) Date of Patent: May 10, 2011

(54) TRANSPORT DEVICE FOR IMAGE RECORDING APPARATUS AND METHOD OF CORRECTING TRANSPORT SPEED IN TRANSPORT DEVICE FOR IMAGE RECORDING APPARATUS

(75) Inventors: Shoji Kakimoto, Kyoto (JP); Masaharu Nakagawa, Kyoto (JP); Keisuke Hirai, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 118 days.

(21) Appl. No.: 12/397,580

(22) Filed: Mar. 4, 2009

(65) Prior Publication Data

US 2009/0295060 A1 Dec. 3, 2009

(30) Foreign Application Priority Data

May 28, 2008 (JP) ..... 2008-139563

(51) Int. Cl.
*B65H 5/34* (2006.01)

(52) U.S. Cl. ..... 271/270; 271/267; 271/268; 347/104

(58) Field of Classification Search ..... 271/270, 271/267, 268; 347/16, 104; 198/345.3
See application file for complete search history.

(56) References Cited

U.S. PATENT DOCUMENTS 5,225,852 A 7/1993 Uchida et al.
7,284,651 B2 * 10/2007 Heinemeier et al. ..... 198/345.3
2004/0201168 A1 10/2004 Greive
2005/0179708 A1 8/2005 Ben-Zur
2007/0236528 A1 10/2007 Oike
2009/0244243 A1 * 10/2009 Nakagawa et al. ..... 347/104
2009/0295080 A1 * 12/2009 Sakai et al. ..... 271/264
2009/0321220 A1 * 12/2009 Ewerlof ..... 198/345.3

FOREIGN PATENT DOCUMENTS

EP 2047958 A1 * 4/2009
JP 4-219264 8/1992
JP 2004-314605 11/2004
JP 2005-131929 5/2005

OTHER PUBLICATIONS

European Search Report issued in European Patent Application No. 09003137.8, mailed May 12, 2009.

* cited by examiner

*Primary Examiner* — Jeremy Severson
(74) *Attorney, Agent, or Firm* — McDermott Will & Emery LLP

(57) ABSTRACT

A transport device which accomplishes transport well by means of a linear motor mechanism well even if a chain is elongated. The transport uses the chain in a first transport section, and the linear motor mechanism in a second transport section. A coupling pin of the chain is disengaged from a chain coupling portion of a table when the table is transferred to the second transport section and the coupling pin is brought into engagement with the chain coupling portion again when the table is transferred to the first transport section. A driving speed at which a pair of rotary members are driven by the chain driving mechanism is corrected in accordance with the elongated condition of the chain, based on a count of driving pulses in the chain driving mechanism during the passage of the coupling pin through the second transport section.

6 Claims, 10 Drawing Sheets

TRANSPORT DEVICE FOR IMAGE RECORDING APPARATUS AND METHOD OF CORRECTING TRANSPORT SPEED IN TRANSPORT DEVICE FOR IMAGE RECORDING APPARATUS

BACKGROUND OF THE INVENTION

1. Field of the Invention

The present invention relates to a transport device for an image recording apparatus and, more particularly, to a transport device which uses a linear motor mechanism and a chain in combination for transport.

2. Description of the Background Art

There is known an image recording apparatus in which, while transport rollers, a transport belt and the like are used to transport a recording medium, ink is ejected from a multiplicity of inkjet nozzles provided in inkjet heads disposed in a transport path of the recording medium onto the recording medium, to thereby record an image on the recording medium. Such an image recording apparatus is disclosed, for example, in Japanese Patent Application Laid-Open Nos. 4-219264 (1992), 2005-131929 and 2004-314605.

For a large amount of high-accuracy printing at a high speed based on inkjet technology, it has been found that the transport of a recording medium in a manner as disclosed in Japanese Patent Application Laid-Open Nos. 4-219264 (1992), 2005-131929 and 2004-314605 is prone to give rise to transport deviation, thereby resulting in insufficient printing accuracy. As an alternative to this, a technique has been under consideration in which a linear motor mechanism is used to transport a table which holds a recording medium thereon in a location where image recording is performed whereas a chain is used to transport the table in other locations. In the use of such a technique, however, there is concern that the elongation of the chain is caused due to deterioration from aging, and the chain elongation negatively affects the accuracy of transport of the table.

SUMMARY OF THE INVENTION

The present invention is intended for an image recording apparatus. More particularly, the invention is intended for a transport device provided in an image recording apparatus and for transporting in an endless manner a holding table for holding a recording medium thereon by using a linear motor mechanism and a chain in combination for the transport.

According to the present invention, the image recording apparatus comprises: a) a transport device for circularly transporting a holding table for holding a recording medium thereon, the transport device including a-1) a chain transport mechanism having a pair of rotary members, a chain looped around the pair of rotary members, and a chain driving mechanism for driving the pair of rotary members, the chain driving mechanism driving the pair of rotary members, with the holding table coupled to the chain by bringing a first coupling member provided on the chain into engagement with a second coupling member provided on the holding table, thereby transporting the holding table, a-2) a linear motor mechanism having a movable element coupled to the holding table and a stator extending in a direction in which the holding table travels, the linear motor mechanism changing the magnetic polarity of the stator to move the holding table, a-3) first and second transport sections, the first transport section being a section in which the chain transport mechanism transports the holding table in the entire transport section over which the holding table is transported, the second transport section being other than the first transport section included in the entire transport section and being a section in which the linear motor mechanism transports the holding table, the second transport section partly including an image recording section, the chain driving mechanism driving the pair of rotary members to move the chain even while the holding table is transported in the second transport section by means of the linear motor mechanism, the first coupling member being disengaged from the second coupling member when the holding table is transferred from the first transport section to the second transport section, the first coupling member being brought into engagement with the second coupling member again when the holding table is transferred from the second transport section to the first transport section, a-4) a first detection element for detecting the first coupling member starting passing through the second transport section during the transport of the holding table, a-5) a second detection element for detecting the first coupling member finishing passing through the second transport section during the transport of the holding table, a-6) a pulse counting element for starting counting driving pulses in response to a detection signal from the first detection element and finishing counting the driving pulses in response to a detection signal from the second detection element to thereby take a count of driving pulses obtained while the pair of rotary members are driven by the chain driving mechanism during the passage of the first coupling member through the second transport section, and a-7) a speed correction element for correcting a driving speed at which the pair of rotary members are driven by the chain driving mechanism in accordance with the elongated condition of the chain or for correcting a driving profile regarding the driving of the holding table by means of the linear motor mechanism in the second transport section in accordance with the elongated condition of the chain, based on the count of driving pulses so that a positional relationship between the first coupling member and the second coupling member relative to each other is held in the second transport section; and b) an image recording part for recording an image on the recording medium, the image recording part recording the image on the recording medium held on the holding table during the passage of the holding table through the image recording section.

Thus, when the transport device is in operation, the elongated condition of the chain is grasped by using the count of driving pulses obtained while the chain driving mechanism drives the rotary members, and the driving speed of the chain is corrected based on the count of driving pulses. This prevents the first coupling member from coming in contact with the second coupling member because the movement of the chain lags behind the transport of the holding table by means of the linear motor mechanism in the second transport section if the chain is elongated due to deterioration from aging, and accomplishes the transport of the table by means of the linear motor mechanism well. The accuracy of image recording is therefore improved in the image recording part.

It is therefore an object of the present invention to provide an image recording apparatus including a transport device which uses a linear motor mechanism and a chain in combination for transport and which accomplishes the transport by means of the linear motor mechanism well if the chain is elongated.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

<General Construction of Image Recording Apparatus>

Figure 1:
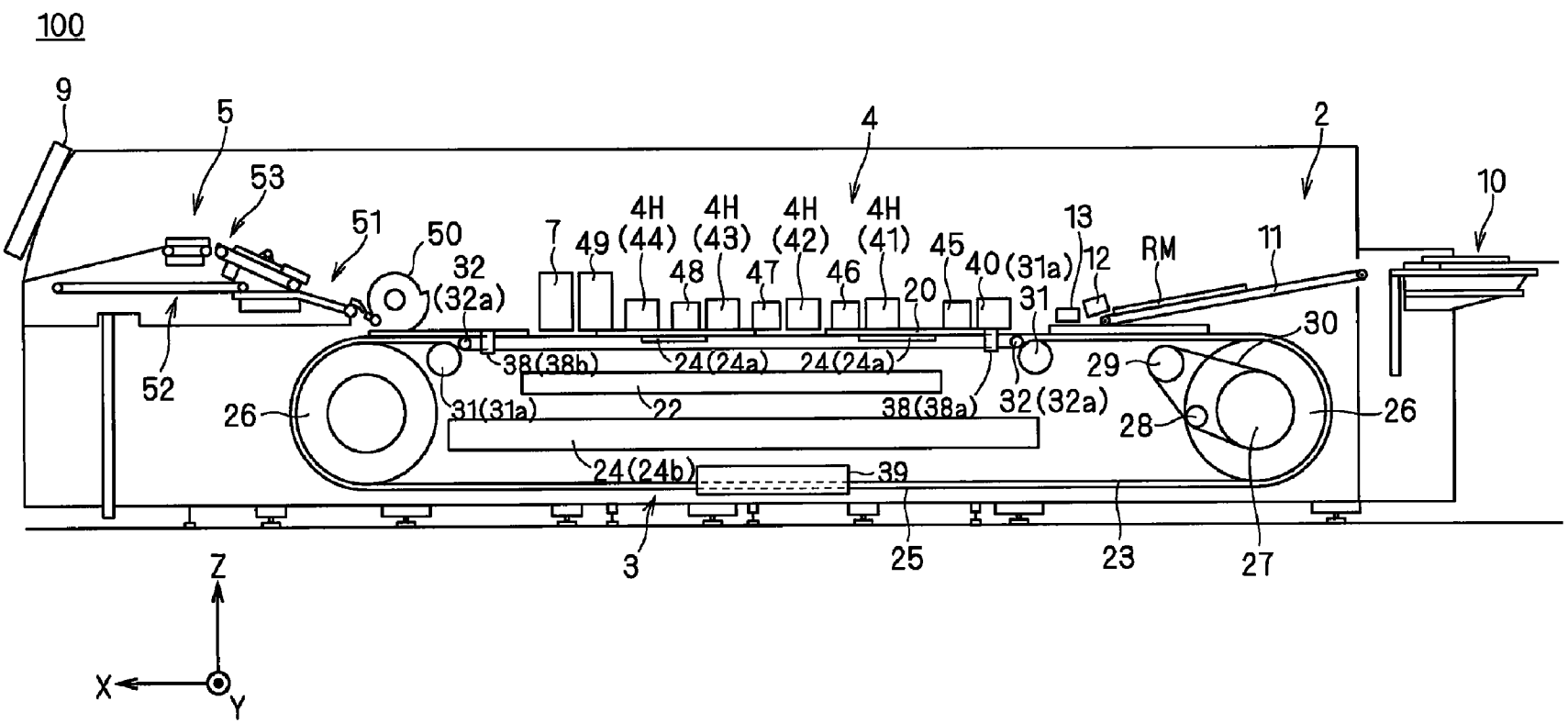
FIG. 1 is a schematic sectional view principally showing the mechanical construction of an image recording apparatus of a fixed head type according to a first preferred embodiment of the present invention.
Figure 2:
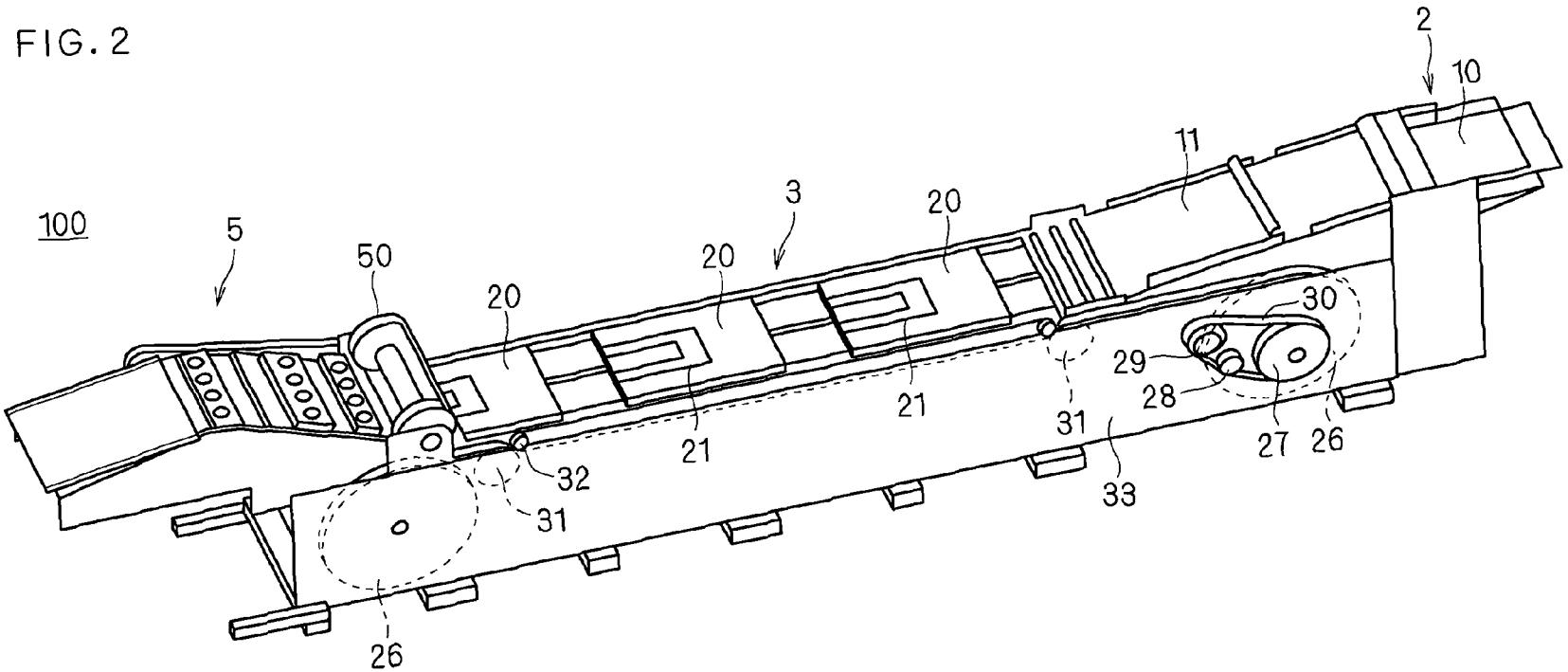
FIG. 2 is a perspective view of principal parts of the image recording apparatus of FIG. 1.

FIG. 1 is a schematic sectional view principally showing the mechanical construction of an image recording apparatus 100 of a fixed head type which is a mode of the image recording apparatus 100 according to a first preferred embodiment of the present invention. FIG. 2 is a perspective view of principal parts of the image recording apparatus 100. An XYZ coordinate system such that a direction in which recording media RM are transported is defined as the positive X direction and a vertically upward direction is defined as the positive Z direction is additionally shown in FIG. 1.

The image recording apparatus 100 is an apparatus for recording an image on the recording media RM such as, for example, printing paper and the like in accordance with descriptions of previously provided image recording data (data about color density values of pixels constituting an image to be recorded). More specifically, the image recording apparatus 100 is an inkjet printer for recording an image by ejecting inks of different colors (e.g., four colors: C (cyan), M (magenta), Y (yellow), and K (black)) corresponding to a plurality of (in FIG. 1, four) inkjet heads 4H (41 to 44), respectively, from the inkjet heads 4H toward the recording media RM. At least two of the plurality of inkjet heads 4H (41 to 44) may eject inks of the same color (e.g., white).

An example of the recording media RM used in this preferred embodiment includes, but is not limited to, typical printing paper (wood free paper and the like). The recording media RM may be made of a material capable of accepting ink, such as a plastic film and the like.

The image recording apparatus 100 principally includes: a supply part 2 for supplying the recording media RM from a pre-recording stocking part 10 for receiving therein the recording media RM to be subjected to image recording; a transport mechanism 3 for transporting the recording media RM along a predetermined transport path PA; an image recording part 4 for ejecting inks from a multiplicity of inkjet nozzles provided at the lower end of each of the inkjet heads 4H (41 to 44) toward the recording media RM passing through the transport path PA; a discharging and receiving part 5 for discharging the recording media RM with an image recorded thereon from the transport path PA to place the recording media RM into a post-recording stocking part (not shown); a scanner 7 for photoelectrically reading the image formed on the recording media RM by the image recording part 4 on the transport path PA; and a display and manipulation part 9 for displaying operating states in the image recording apparatus 100 and various manipulation menus and for allowing an operator to perform input manipulations in accordance with the manipulation menus. The image recording apparatus 100 further includes a controller 8 for controlling the entire operations thereof (with reference to FIG. 6), although not shown in FIGS. 1 and 2.

In the image recording apparatus 100, all of the inkjet heads 4H (the head 41 for black, the head 42 for cyan, the head 43 for magenta, and the head 44 for yellow) are fixedly provided in predetermined positions. Recording of an image is achieved by ejecting inks from the plurality of inkjet nozzles provided at the lower end of each of the inkjet heads 4H in synchronism with the travel of the recording media RM directly under each of the inkjet heads 4H. The plurality of inkjet nozzles in each of the inkjet heads 4H are disposed to eject ink at equal intervals within an image recording area along the width of the recording media RM (in the Y direction as viewed in FIG. 1) toward the recording media RM transported directly thereunder so that the image is recorded on the entire surface of each of the recording media RM. As far as such a requirement is satisfied, the arrangement of the plurality of inkjet nozzles may be determined as appropriate.

In such an image recording apparatus 100, the transport mechanism 3 includes a plurality of tables (holding tables) 20 each capable of holding a single recording medium RM thereon under suction through a suction hole 21 provided therein. The individual recording media RM are sequentially supplied from the pre-recording stocking part 10 to the tables 20, respectively, by a conveyor 11 provided in the supply part 2, and are transported on the transport path PA while being held on the respective tables 20 under suction through the respective suction holes 21. Specifically, a vacuum fan 22 is provided under the transport path of the tables 20, and exhausts air to thereby allow a recording medium RM to be held on each of the tables 20 under suction through the suction hole 21.

A first positioning mechanism 12 and a second positioning mechanism 13 are provided in a front area of the supply part 2 as viewed in the direction of the travel of the recording media RM (or in a front area thereof as viewed in the direction of the travel of the conveyor 11). The first positioning mechanism 12 is provided for the positioning of the recording media RM in a direction perpendicular to the transport direction of the recording media RM (i.e., in the Y direction as seen in FIG. 1). The second positioning mechanism 13 is provided for the positioning of the recording media RM in the transport direction of the recording media RM.

Figure 3:
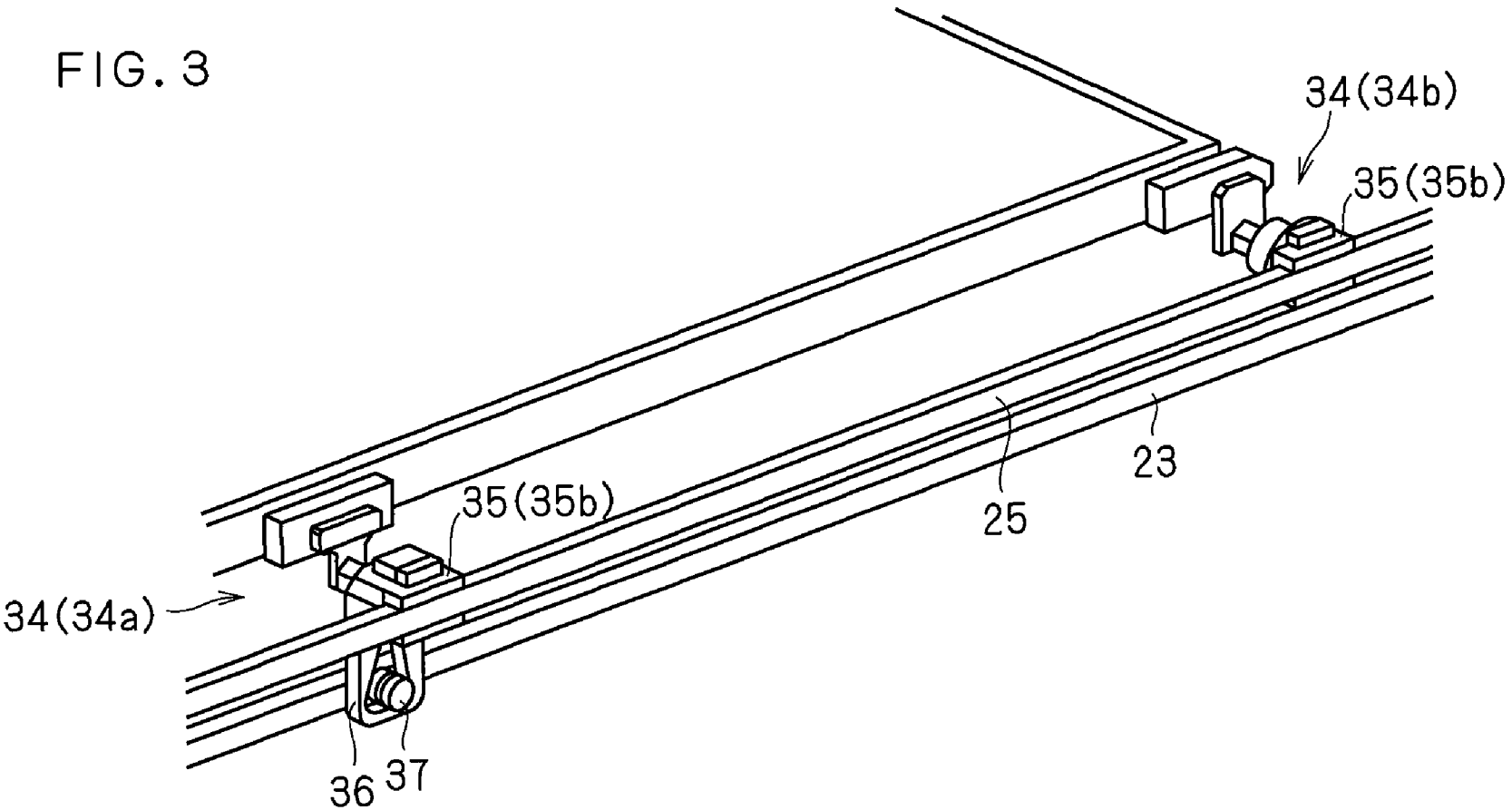
FIG. 3 is a partial perspective view showing components related to the transport of a table in a transport mechanism in further detail.
Figure 4:
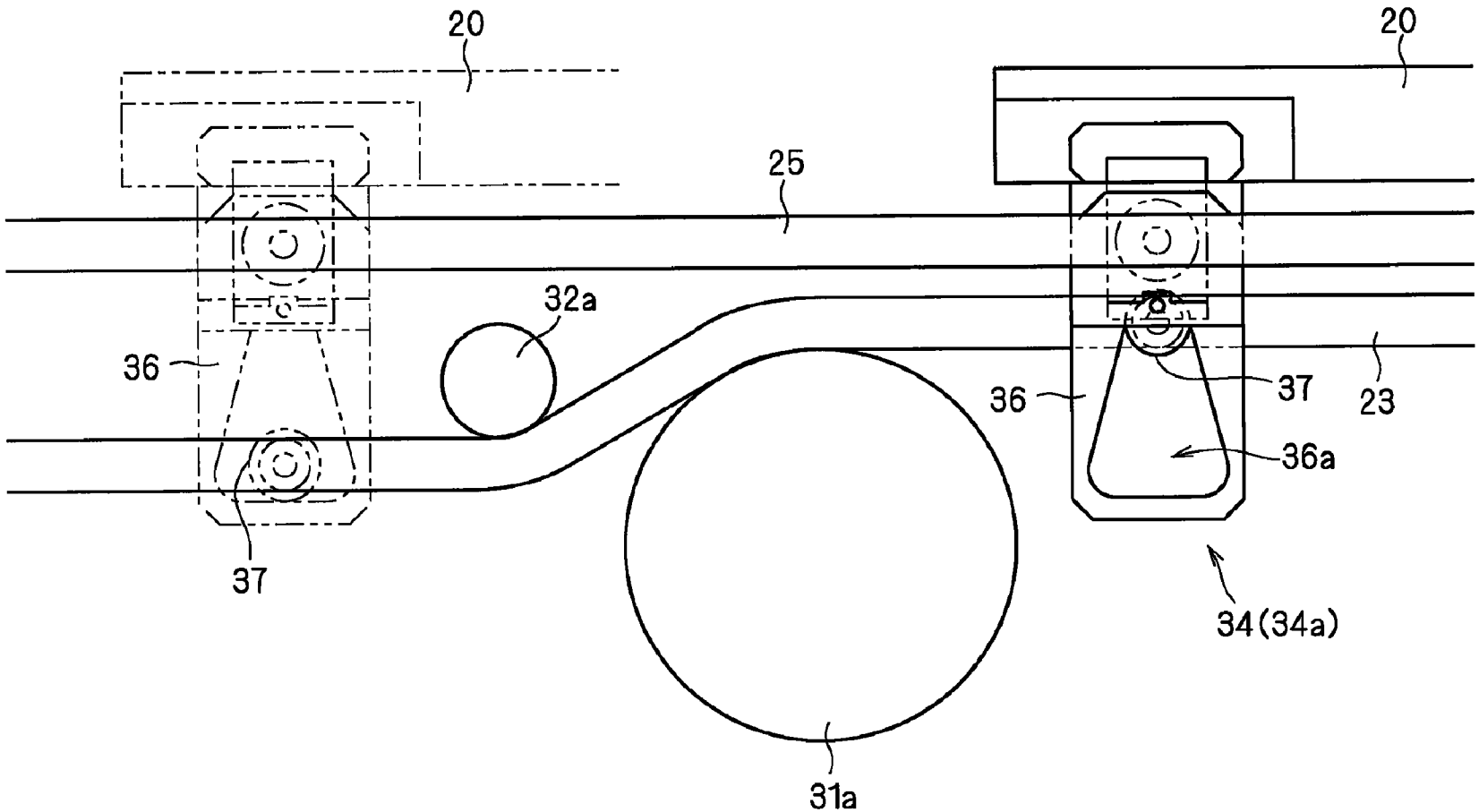
FIG. 4 is a partial view showing the coupling between the table and a chain in detail.

FIG. 3 is a partial perspective view showing components related to the transport of each table 20 in the transport mechanism 3 in further detail. FIG. 4 is a partial view showing the coupling between each table 20 and a chain 23 in detail. More specifically, each of the plurality of tables 20 includes coupling portions 34 (first coupling portions 34*a* and second coupling portions 34*b*) at the four corners thereof. The coupling portions 34 include guide receiving portions 35 (35*a* and 35*b*), respectively, for engagement with endless guides 25 disposed on opposite side panels 33. The guide receiving portions 35 enable each of the tables 20 to be guided along the guides 25 and to be transported circularly in the transport mechanism 3. Of the coupling portions 34 of the tables 20, each the first coupling portions 34*a* disposed at the front as viewed in the direction of the travel is provided with a chain coupling portion 36 having a generally triangular hole 36*a*. The chain coupling portion 36 of each of the tables 20 is brought into engagement with a coupling pin 37 provided on the chain 23, as indicated by solid lines in FIG. 4, whereby each of the tables 20 is coupled to the endless chain 23 looped around a pair of sprockets 26 disposed on the opposite side panels 33 while being spaced a predetermined distance apart from the chain 23. The pair of sprockets 26 are provided with a pulse encoder 26*e* (with reference to FIG. 8) not shown in FIGS. 1 and 2 for generating N pulses per one rotation of the sprockets 26 (where N is a positive integer). The pulse encoder 26*e* is used for the correction of a chain driving speed to be described later.

As shown in FIGS. 1 and 2, a sprocket 27 is attached to one side of one of the sprockets 26, and is coupled to a driving sprocket 28 and a driven sprocket 29 with a chain 30. The driving sprocket 28 is provided so as to be rotated by driving a chain driving motor 28*m* (with reference to FIG. 8) not shown in FIGS. 1 and 2. As the chain driving motor 28*m* is driven, the chain 23 looped around the pair of sprockets 26 accordingly moves around to move the tables 20 along the guides 25.

The vertical position of the chain 23 is changed partially by combining a pair of sprockets 31 (31*a* and 31*b*) and a pair of sprockets 32 (32*a* and 32*b*) together. Specifically, the chain coupling portion 36 and the coupling pin 37 are decoupled from each other past a location in which the sprocket 31*a* and the sprockets 32*a* are disposed in combination, as indicated by dash-double dot lines in FIG. 4. The tables 20 are moved by a linear motor mechanism 24 from this location to a location in which the sprocket 31*b* and the sprocket 32*b* are disposed in combination, while being guided by the guides 25. Such a condition is illustrated in FIG. 3.

This is to enhance the accuracy of travel of the tables 20 (i.e., the accuracy of transport of the recording media RM) during the passage of the tables 20 directly under the image recording part 4 and the scanner 7. Thus, reductions are achieved in image recording errors (ejection in improper positions) in the image recording part 4 and in reading errors in the scanner 7. Specifically, a deviation in the transport position of the recording media RM results in a deviation in image recording position and in image reading position. It is hence important to ensure the accuracy of travel of the tables 20.

The linear motor mechanism 24 includes a movable element 24*a* provided under a table 20 attachably to and detachably from the table 20, and a stator 24*b* extending in the direction of travel of the table 20. With the movable element 24*a* coupled to the table 20, the table 20 is moved by changing the magnetic polarity of the stator 24*b*. Preferably, the movable element 24*a* is attached to the table 20 when the chain coupling portion 36 and the coupling pin 37 are decoupled from each other, and is released from the table 20 when the chain coupling portion 36 and the coupling pin 37 are coupled to each other again after the transport by means of the linear motor mechanism 24 is completed.

A pair of sensors 38 (a first sensor 38*a* and a second sensor 38*b*) are provided in opposite end positions of a section in which the tables 20 are transported by means of the linear motor mechanism 24 (also referred to hereinafter as a linear transport section). The pair of sensors 38 are provided to detect the passage of the coupling pin 37 provided on the chain 23 therethrough. A detection signal indicative of the detection of the coupling pin 37 is used for the correction of the driving speed of the chain 23. The correction of the driving speed of the chain 23 will be described later. The positions in which the sensors 38 are provided in FIG. 1 are only illustrative, and are not limited as far as the sensors 38 are able to detect the passage of the coupling pin 37 therethrough for the above-mentioned purpose.

The transport mechanism 3 of the image recording apparatus 100 further includes a chain tension adjustment mechanism 39 provided in a position through which the chain 23 passes and for adjusting the tension of the chain 23 which is elongated due to deterioration from aging. The elongation of the chain 23 lowers the accuracy of transport of the tables 20. For the purpose of ensuring the accuracy of image recording, it is therefore important to maintain the good tension of the chain 23.

Figure 5:
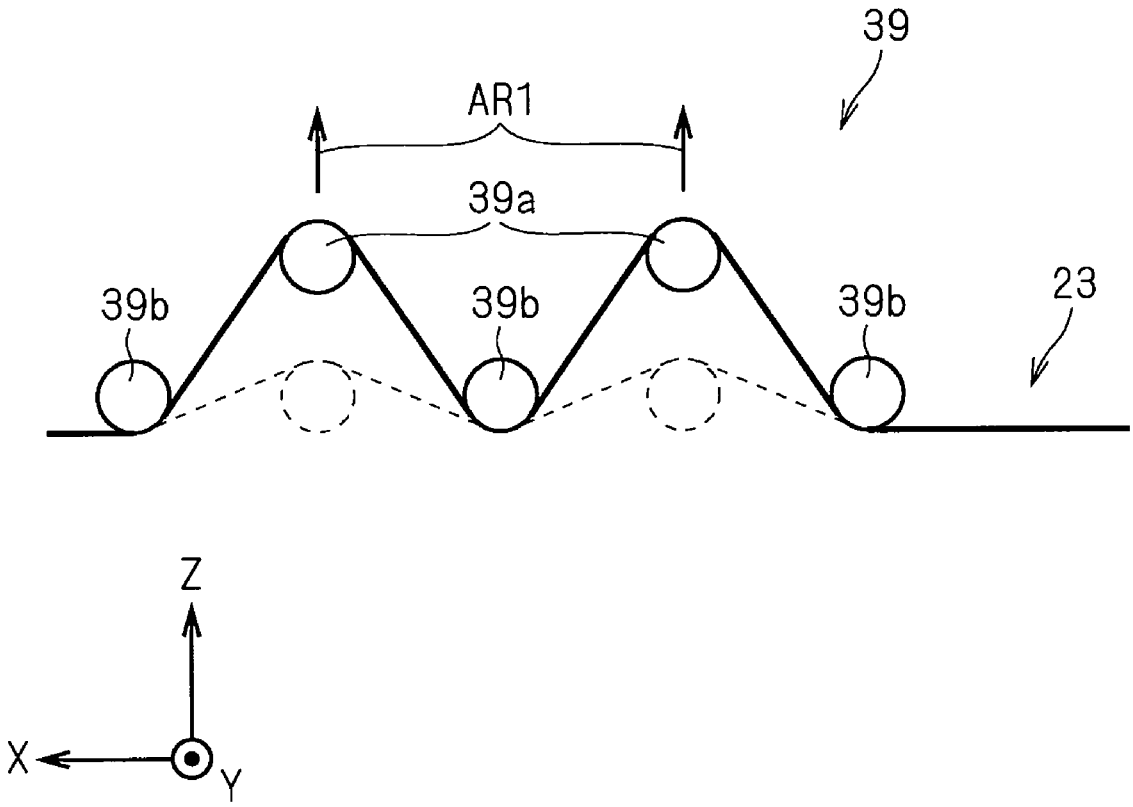
FIG. 5 is a view for illustrating a chain tension adjustment mechanism.

FIG. 5 is a view for illustrating the chain tension adjustment mechanism 39. The chain tension adjustment mechanism 39 includes alternating movable and fixed members 39*a* and 39*b* which are circular in cross section. The chain 23 extends across the upper surface of each of the movable members 39*a* and the lower surface of each of the fixed members 39*b* in order while being maintained in tension. The position of the movable members 39*a* is adjustable in the positive Z direction (in a vertically upward direction) as indicated by arrows AR1. The good tension of the chain 23 is maintained by appropriately changing the position of the movable members 39*a* in accordance with on the degree of elongation of the chain 23.

The position of the chain tension adjustment mechanism 39 in FIG. 1 and the configuration and number of movable and fixed members 39*a* and 39*b* in FIG. 5 are only illustrative and are not limited to those shown in FIGS. 1 and 5 as far as the tension of the chain 23 is adjustable. The provision of the chain tension adjustment mechanism 39 in the image recording apparatus 100 according to this preferred embodiment is not essential because the speed of the chain is correctable in a manner to be described below.

This is to say, the image recording apparatus 100 including the transport mechanism 3 as described above ensures the sufficient accuracy of the holding position of the recording media RM on the tables 20 and the sufficient accuracy of transport of the tables 20 during the image recording in the image recording part 4 and during the image reading in the scanner 7.

The image recording apparatus 100 further includes a pre-processing agent ejection head 40 provided upstream from the inkjet heads 4H in the transport path PA and for applying a less visible (e.g., transparent) pre-processing agent to the recording media RM prior to the ejection of ink from the inkjet heads 4H for the purpose of enhancing the fixability of the ink ejected from the inkjet heads 4H. The application of such a pre-processing agent is preferable for the image recording especially on recording media RM made of a material poor in ink fixability.

The image recording apparatus 100 further includes heaters 45, 46, 47, 48 and 49 provided downstream from the pre-processing agent ejection head 40 and the inkjet heads 4H, respectively, and for blowing hot air onto the recording media RM. The heater 45 is provided for pre-heating, the heaters 46, 47 and 48 are provided for intermediate heating, and the heater 49 is provided for main heating.

The pre-processing agent ejection head 40, the inkjet heads 4H, the heaters 45 to 49 and the scanner 7 are movable by a drive mechanism not shown in a direction orthogonal to the transport direction of the recording media RM (in a direction perpendicular to the plane of FIG. 1). This enables the pre-processing agent ejection head 40, the inkjet heads 4H, the heaters 45 to 49 and the scanner 7 to reciprocatingly move between an image recording position opposed to the transport path PA of the recording media RM and a maintenance position not opposed to the transport path PA of the recording media RM. During a maintenance operation, the pre-processing agent ejection head 40, the inkjet heads 4H, the heaters 45 to 49 and the scanner 7 are moved to the maintenance position. This removes obstructions on the transport path PA of the recording media RM to ensure the working space for the maintenance operation of the tables 20 and the like.

The discharging and receiving part 5 includes a discharge drum 50. The discharge drum 50 separates the recording media RM from the tables 20 by winding the recording media RM around an outer peripheral portion thereof.

In the discharging and receiving part 5, an outlet passage switching mechanism 51 allows selection between the use of a first outlet passage 52 and the use of a second outlet passage 53 in accordance with a switching instruction from the controller 8. Specifically, each of the first outlet passage 52 and the second outlet passage 53 includes a conveyor. The first outlet passage 52 and the second outlet passage 53 are provided with individual stocking parts (post-recording stocking parts), respectively, for receiving the recording media RM therein. Preferably, the outlet passage switching mechanism 51 operates so that recording media RM subjected to a normal (or proper) image recording process are received in the discharging and receiving part 5 through the first outlet passage 52, and other recording media RM are received in the discharging and receiving part 5 through the second outlet passage 53.

The scanner 7 includes a linear CCD camera, and is adapted to photoelectrically read all or part (a patch and the like) of the image recorded on the recording media RM in response to a reading instruction from the controller 8. Typically, the scanner 7 reads the image recorded by the image recording part 4. In some cases, however, the scanner 7 reads an image without the image recording in the image recording part 4.

The display and manipulation part 9 is a display device of a touch panel type. Specifically, with various menus and the like displayed on a screen of the display and manipulation part 9, an operator touches a predetermined position of the screen to perform an input manipulation. Thus, the display and manipulation part 9 is an integral unit composed of a display part and an input manipulation part as conceptual components. Such a configuration of the display and manipulation part 9 is not essential, but the display and manipulation part 9 may be configured, for example, such that a display part such as a liquid crystal display and an input manipulation part including a plurality of key buttons are provided separately.

<Details of Construction of Controller>

Figure 6:
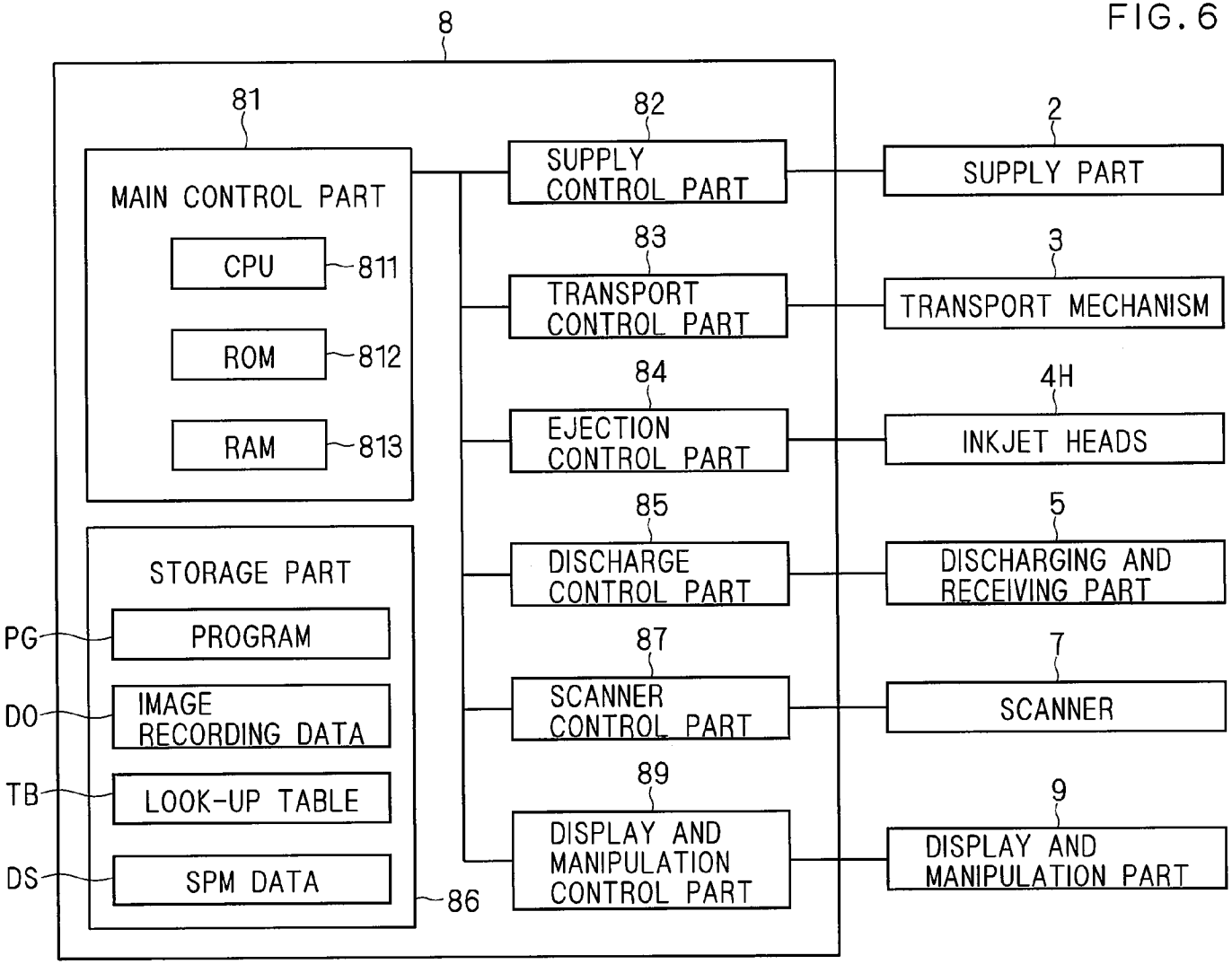
FIG. 6 is a block diagram showing the construction of a controller.

Next, the controller 8 provided in the image recording apparatus 100 will be described in detail. FIG. 6 is a block diagram showing the construction of the controller 8.

The controller 8 includes: a main control part 81 having a CPU 811, a ROM 812, a RAM 813 and the like and for effecting centralized control of the operation of the entire image recording apparatus 100 including the image recording process; a supply control part 82 for controlling the operation of the supply part 2; a transport control part 83 for controlling the operation of the transport mechanism 3; an ejection control part 84 for controlling the operation of ejecting ink from the inkjet heads 4H (and also controlling the ejecting operation of the pre-processing agent ejection head 40 in the image recording apparatus 100); a discharge control part 85 for controlling the operation of the discharging and receiving part 5; a scanner control part 87 for controlling the operation of the scanner 7; and a display and manipulation control part 89 for controlling the operation of the display and manipulation part 9.

The supply control part 82, the transport control part 83, the ejection control part 84, the discharge control part 85, the scanner control part 87 and the display and manipulation control part 89 may be provided in the form of respective purpose-built control circuits, and may have a CPU, a ROM, a RAM and the like in a manner similar to the main control part 81. Further, the main control part 81 may also have the functions of the respective control parts.

The controller 8 further includes a storage part 86 composed of, for example, a hard disk and the like. The storage part 86 stores therein a program PG executed in the CPU 811 to thereby perform various functions in the main control part 81, and various data related to the operation of the image recording apparatus 100. Examples of the data stored in the storage part 86 include image recording data D0 about descriptions of recording (color density values for respective pixel positions (XY addresses) described based on a CMYK color system) of an image to be recorded, a look-up table TB containing descriptions about a relationship (a tone reproduction curve) between the color density values and the amount of ink ejection for the individual inkjet nozzles, and SPM (screen pattern memory) data DS specifying how to eject ink to form pixels having a given color density value. The image recording data D0 may be held in the RAM 813.

<Correction of Chain Driving Speed>

Next, the correction of the chain driving speed in the transport mechanism 3 of the image recording apparatus 100 will be described.

As mentioned above, the tension of the chain 23 is adjustable by the chain tension adjustment mechanism 39 because the chain 23 is elongated due to deterioration from aging in the image recording apparatus 100. Such an adjustment is allowed only within the range of movement of the movable members 39*a* of the chain tension adjustment mechanism 39. Thus, if the chain 23 is elongated to the extent no longer adjustable by the chain tension adjustment mechanism 39 (or if the chain tension adjustment mechanism 39 itself is not provided), trouble occurs in the transport of the tables 20 by means of the linear motor mechanism 24.

Figure 7A:
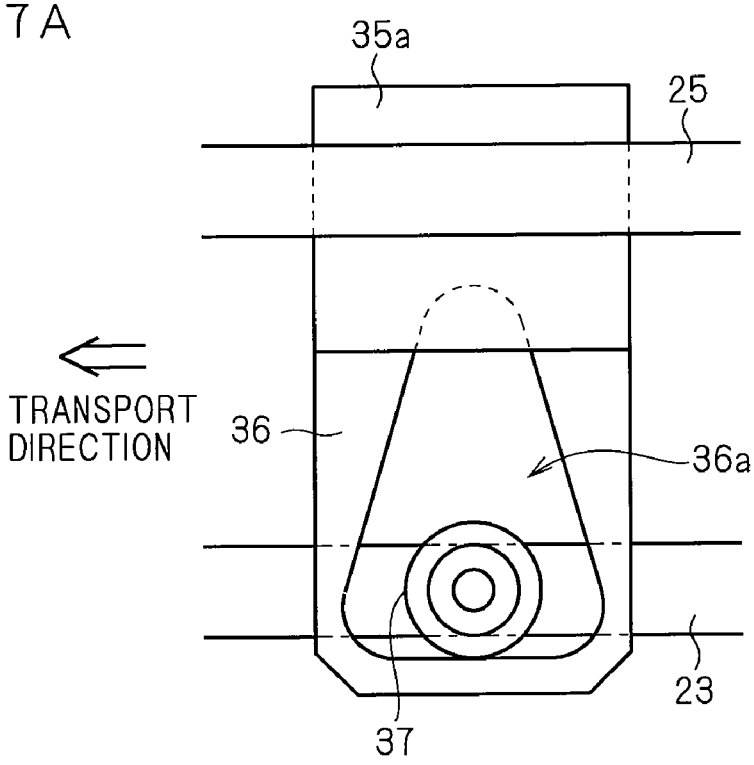
FIGS. 7A and 7B are views showing a positional relationship between a chain coupling portion provided on the table and a coupling pin of the chain during transport by means of a linear motor mechanism.
Figure 7B:
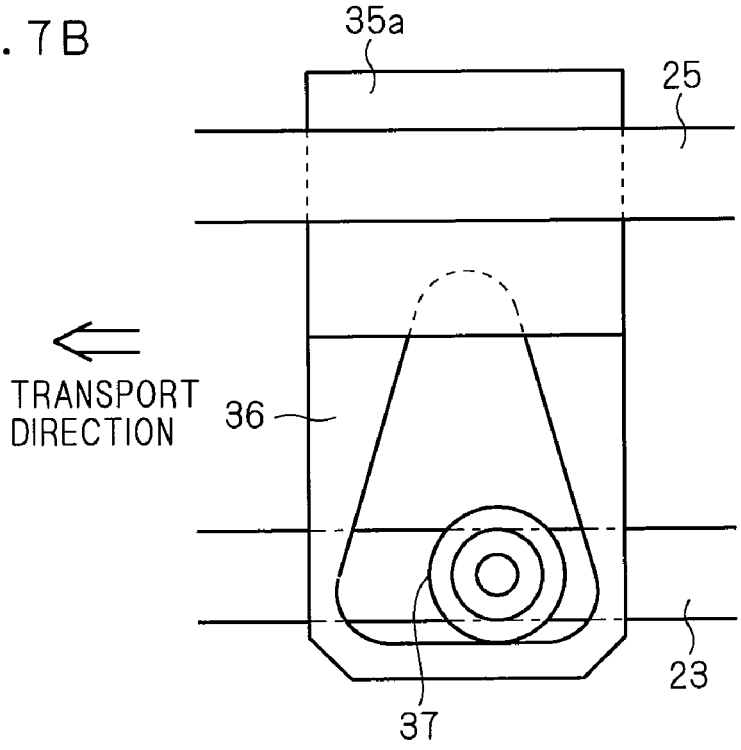

FIGS. 7A and 7B are views showing positional relationships between the chain coupling portion 36 provided on a table 20 and the coupling pin 37 of the chain 23 during the transport by means of the linear motor mechanism 24, for the purpose of illustrating the trouble. When the table 20 is transported by means of the linear motor mechanism 24 (not shown in FIGS. 7A and 7B), the chain coupling portion 36 associated with the table 20 also travels at a speed equal to the transport speed of the table 20 as a matter of course. The transport speed of the table 20 is generally determined to have a fixed value from the viewpoint of advantageously performing the image recording in the image recording part 4 and the reading of the recorded image in the scanner 7. On the other hand, the coupling pin 37 is not in engagement with the hole 36*a* of the chain coupling portion 36, but the chain 23 itself is driven by the chain driving motor 28*m*. Thus, the coupling pin 37 travels at a predetermined speed. The driving speed of the chain 23 at this time is determined so that the speed of travel of the coupling pin 37 is approximately equal to the speed of travel of the chain coupling portion 36 (i.e., the transport speed of the table 20).

When the chain 23 is not elongated or the tension of the chain 23 is adjusted well by the chain tension adjustment mechanism 39 (in an ideal condition), the coupling pin 37 of the chain 23 is held in a substantially middle position of the hole 36*a* of the chain coupling portion 36 (or in a position slightly forward of the substantially middle position as viewed in the transport direction of the table 20 and out of contact with the chain coupling portion 36), as shown in FIG. 7A, during the transport by means of the linear motor mechanism 24.

On the other hand, when the chain 23 is elongated and the tension of the chain 23 is not adjusted by the chain tension adjustment mechanism 39 (in an elongated condition), there is slack in the chain 23 between the pair of sprockets 26. For this reason, if the chain 23 is driven at a driving speed similar to that in the ideal condition, the chain 23 does not move in the linear transport section in accordance with the driving speed to result in a delay in the travel of the coupling pin 37. Thus, the position of the coupling pin 37 is deviated rearwardly from the middle position of the hole 36*a* of the chain coupling portion 36 as viewed in the transport direction of the table 20, as shown in FIG. 7B. As such an elongated condition develops, the coupling pin 37 comes into contact with the chain coupling portion 36 in due course. Such contact gives rise to a deviation in the transport of the table 20 to result in the poor accuracy of image recording. It is hence necessary to adjust the driving speed of the chain 23 so that the coupling pin 37 does not come into contact with the chain coupling portion 36 (or so that the coupling pin 37 is held in the substantially middle position of the hole 36*a*).

The image recording apparatus 100 according to this preferred embodiment is capable of correcting the driving speed of the chain 23, as appropriate, so that the movement of the chain 23 follows the transport of the table 20 by means of the linear motor mechanism 24 without any delay or lag even when the chain tension adjustment mechanism 39 is unable to adjust the tension of the chain 23.

Figure 8:
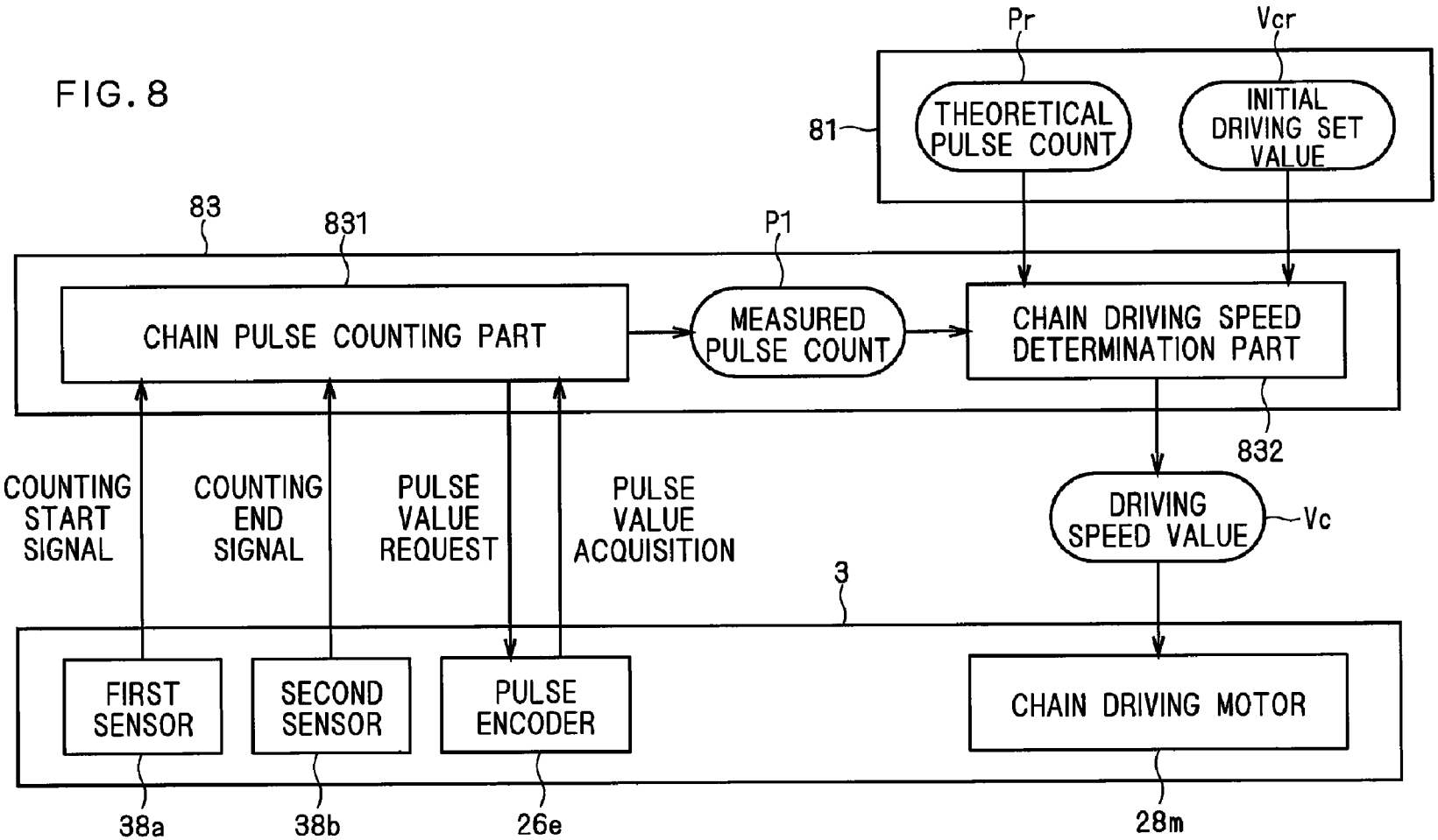
FIG. 8 is a diagram showing components related to the correction of the driving speed of the chain together with the flow of associated data.

FIG. 8 is a diagram showing components related to the correction of the driving speed of the chain 23 together with the flow of associated data. Specifically, the transport control part 83 for controlling the transport mechanism 3 in the image recording apparatus 100 according to the first preferred embodiment includes a chain pulse counting part 831 and a chain driving speed determination part 832 as the components related to the correction of the driving speed of the chain 23. Alternatively, the main control part 81 may include the chain pulse counting part 831 and the chain driving speed determination part 832.

When a detection signal (a counting start signal) indicative of the passage of a coupling pin 37 through the first sensor 38*a* is given from the first sensor 38*a* to the chain pulse counting part 831 during the transport of the tables 20 by means of the transport mechanism 3 (e.g., during the image recording process performed by the image recording part 4), the chain pulse counting part 831 requests the pulse encoder 26*e* to send a pulse value at that time in response to the detection signal to thereby acquire the pulse value. Next, when a detection signal (a counting end signal) indicative of the passage of the same coupling pin 37 through the second sensor 38*b* is given from the second sensor 38*b* to the chain pulse counting part 831, the chain pulse counting part 831 requests the pulse encoder 26*e* to send a pulse value at that time in response to the detection signal to thereby acquire the pulse value. Then, the chain pulse counting part 831 generates a measured pulse count (a drive pulse count) P1 which is a difference between the two pulse values. The measured pulse count P1 is a value serving as an indication of the degree of elongation of the chain 23. This is because, if the chain driving motor 28*m* is operated when the chain 23 is elongated, the chain 23 meanders to move a longer distance (not necessarily equal to the distance of the linear transport section) during the passage through the linear transport section than that in the ideal condition. Thus, the chain 23 at one end position of the linear transport section is unable to reach the other end position thereof unless a pulse count higher than that in the ideal condition is taken to feed the chain 23.

More specifically, a table 20 comes to the linear transport section, whereby the coupling pin 37 of the chain 23 disengaged from the chain coupling portion 36 provided on the table 20 is detected by the first sensor 38*a*. Further, the coupling pin 37 is detected by the second sensor 38*b* immediately before the coupling pin 37 is brought into engagement with the chain coupling portion 36 of the same table 20 at the termination position of the linear transport section. A plurality of coupling pins 37 may be used for the counting.

The chain driving speed determination part 832 determines the driving speed value Vc of the chain 23, based on the measured pulse count P1 provided from the chain pulse counting part 831, a theoretical pulse count Pr previously determined and held in the RAM 813 of the main control part 81 (or in the storage part 86) and an initial driving set value Vcr. In the image recording apparatus 100, the chain driving motor 28*m* drives the chain 23 in accordance with the driving speed value Vc determined by the chain driving speed determination part 832. The theoretical pulse count Pr is a pulse count provided when the chain 23 is not elongated, and the initial driving set value Vcr is a driving speed value provided when the chain 23 is driven using the theoretical pulse count Pr.

More specifically, the chain driving speed determination part 832 determines the driving speed value Vc, based on $$Vc=Vcr\cdot(P1/Pr)\cdot a+b \quad (1)$$

where a and b are predetermined coefficients. In the ideal condition, P1=Pr and Vc=Vcr. For example, when Vcr=1000 mm/sec and Pr=20000 and the chain is elongated 0.1%, then P1=20020. Assuming that the coefficients a and b are 1 and 0 respectively, Vc=1001 mm/sec from Equation (1). Thus, the delay in the transport of the chain 23 resulting from the elongation of the chain 23 is eliminated by increasing the chain driving speed by 1 mm/sec.

Thus, the elongated condition of the chain 23 is grasped by using the measured pulse count P1 each time the coupling pin 37 to be detected passes through the first sensor 38*a* and the second sensor 38*b* when the transport mechanism 3 is in operation. Also, the chain 23 is driven while the driving speed is corrected in accordance with Equation (1). This enables the chain 23 to be driven so that the movement of the chain 23 follows the transport of the table 20 by means of the linear motor mechanism 24 without any delay or lag if the chain 23 is elongated. As a result, the transport of the table 20 by means of the linear motor mechanism 24 is prevented from being influenced by the delay or lag in the movement of the chain 23.

As described above, the image recording apparatus 100 according to the first preferred embodiment grasps the elongated condition of the chain 23 by using the measured pulse count P1 to correct the driving speed of the chain 23 based on the measured pulse count P1 when the transport mechanism 3 is in operation. This accomplishes the transport of the tables 20 by means of the linear motor mechanism 24 well if the chain 23 is elongated.

Second Preferred Embodiment

In the first preferred embodiment mentioned above, the occurrence of trouble such that the coupling pin 37 comes in contact with the chain coupling portion 36 as the chain 23 is elongated is prevented by correcting the driving speed of the chain 23. However, the process for preventing such trouble is not limited to this. A second preferred embodiment according to the present invention shows that the contact between the coupling pin 37 and the chain coupling portion 36 is prevented by adjusting the transport speed of the tables 20 by means of the linear motor mechanism 24.

Figure 9:
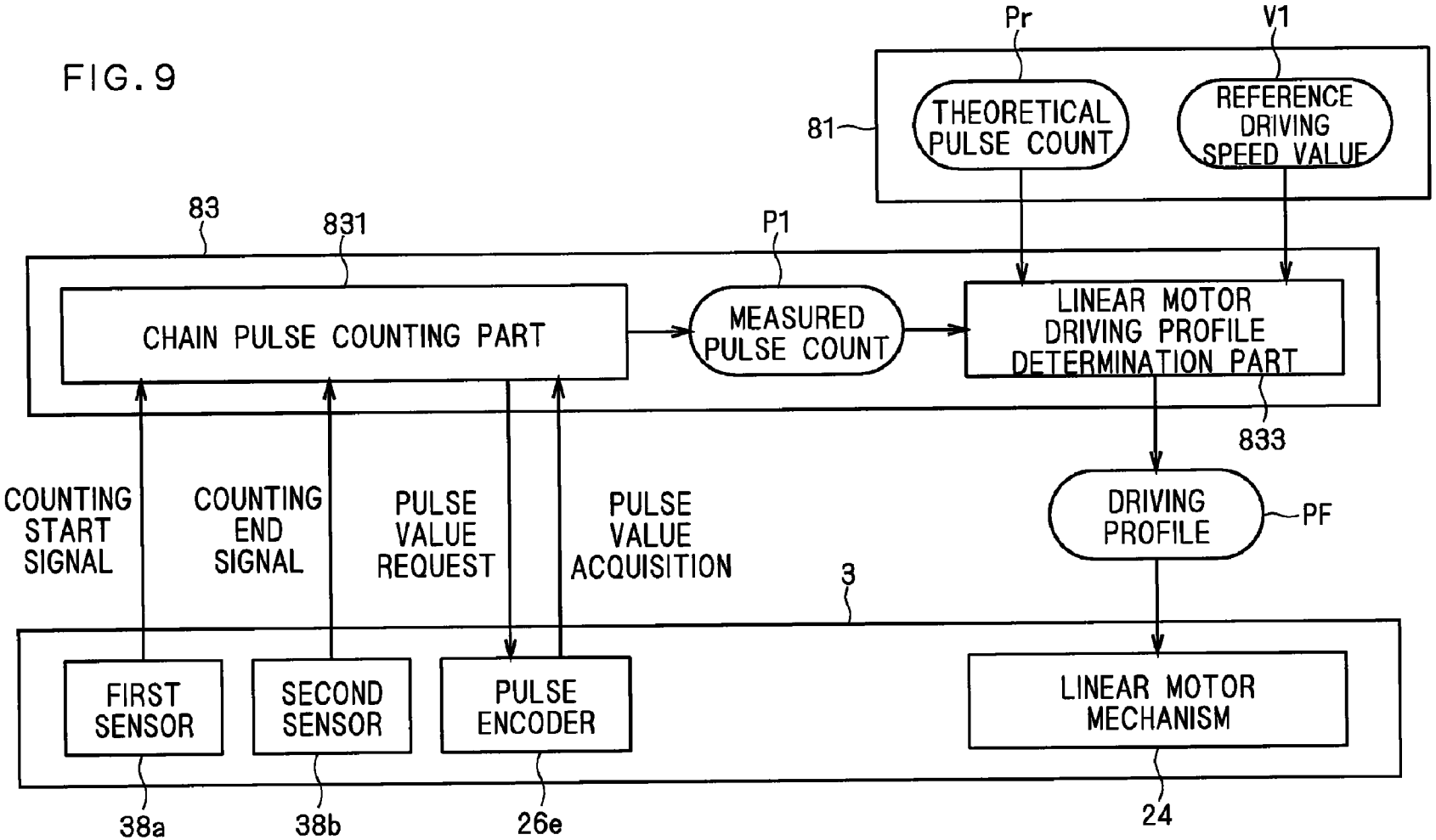
FIG. 9 is a diagram showing components related to the correction of the transport speed of the table in a linear transport section together with the flow of associated data according to a second preferred embodiment of the present invention.

FIG. 9 is a diagram showing components related to the correction of the transport speed of the tables 20 in the linear transport section together with the flow of associated data according to the second preferred embodiment of the present invention.

The second preferred embodiment is similar in the following operation to the first preferred embodiment. When the detection signal (the counting start signal) indicative of the passage of a coupling pin 37 through the first sensor 38*a* is given from the first sensor 38*a* to the chain pulse counting part 831 during the transport of the tables 20 by means of the transport mechanism 3 (e.g., during the image recording process performed by the image recording part 4), the chain pulse counting part 831 requests the pulse encoder 26*e* to send the pulse value at that time in response to the detection signal to thereby acquire the pulse value. Next, when the detection signal (the counting end signal) indicative of the passage of the same coupling pin 37 through the second sensor 38*b* is given from the second sensor 38*b* to the chain pulse counting part 831, the chain pulse counting part 831 requests the pulse encoder 26*e* to send the pulse value at that time in response to the detection signal to thereby acquire the pulse value. Then, the chain pulse counting part 831 generates the measured pulse count P1 which is a difference between the two pulse values.

The following operation of the second preferred embodiment is also similar to that of the first preferred embodiment. A table 20 comes to the linear transport section, whereby the coupling pin 37 of the chain 23 disengaged from the chain coupling portion 36 provided on the table 20 is detected by the first sensor 38*a*. Further, the coupling pin 37 is detected by the second sensor 38*b* immediately before the coupling pin 37 is brought into engagement with the chain coupling portion 36 of the same table 20 at the termination position of the linear transport section.

The image recording apparatus 100 according to the second preferred embodiment, however, differs from that according to the first preferred embodiment in that the transport control part 83 includes a linear motor driving profile determination part 833 in place of the chain driving speed determination part 832.

The linear motor driving profile determination part 833 determines the driving profile PF of the table 20, based on the measured pulse count P1 provided from the chain pulse counting part 831, the theoretical pulse count Pr previously determined and held in the RAM 813 of the main control part 81 (or in the storage part 86) and a reference driving speed value V1.

The driving profile PF used herein refers to information which specifies a corresponding relationship between the position and the driving speed of the table 20 during the transport of the table 20 in the linear transport section by means of the linear motor mechanism 24. In the image recording apparatus 100 according to the second preferred embodiment, the linear motor mechanism 24 transports the table 20 in accordance with the driving profile PF determined by the linear motor driving profile determination part 833. The theoretical pulse count Pr is a pulse count provided when the chain 23 is not elongated, and the reference driving speed value V1 is the driving speed of the table 20 in a minimum section (a constant-speed section) in which the tables 20 are required to be transported at a constant speed in the linear transport section. An example of the minimum section is a section directly under the image recording part 4 and the scanner 7.

Figure 10:
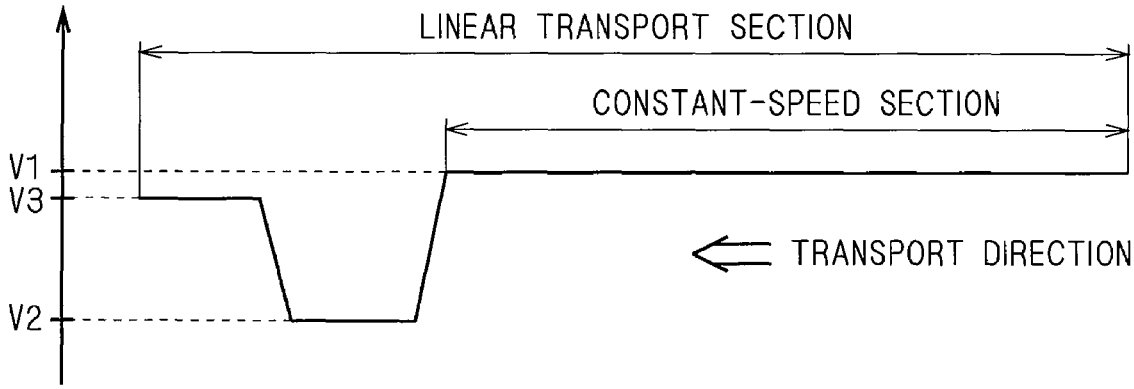
FIG. 10 illustrates a driving profile provided according to the second preferred embodiment when the chain is in an elongated condition.

FIG. 10 illustrates the driving profile PF provided according to the second preferred embodiment when the chain is in the elongated condition. According to the driving profile PF, the table 20 is transported at the speed V1 in the constant-speed section, and is slowed down to a speed V2 immediately after passing through the constant-speed section. Then, after moving a predetermined distance, the table 20 is speeded up again to reach the termination position of the linear transport section at a speed V3.

When the chain 23 is in the ideal condition, the movement speed of the chain 23 is substantially constant and equal to the reference driving speed value V1. However, when the chain 23 is in the elongated condition, the transport speed of the table 20 is higher than the movement speed of the chain 23 in the constant-speed section. Thus, the coupling pin 37 of the chain 23 lags gradually behind the chain coupling portion 36. For this reason, the driving profile PF is determined so as to slow down the table 20 after the table 20 passes through the constant-speed section to reduce the difference in speed between the table 20 and the chain 23, thereby eliminating the lag of the coupling pin 37 behind the chain coupling portion 36.

The speed V3 is determined so that the change from the transport by means of the linear motor mechanism 24 to the transport by means of the chain 23 is made advantageously. It is not necessary that V3≠V1.

More specifically, the chain driving speed determination part 832 determines the speeds V2 and V3, based on a speed calculation table previously set and stored in the storage part 86 and the like. Table 1 shows an example of the speed calculation table when V1=500 pps.

TABLE 1

| P1 (Encoder Pulses) | V2 (pps) | V3 (pps) |
|---|---|---|
| 20000 | 500 | 500 |
| 20010 | 499.75 | 500 |
| 20020 | 499.5 | 500 |
| 20030 | 499.25 | 500 |

The values of the speeds V2 and V3 for the values of the measured pulse count P1 not shown in Table 1 are found by linear interpolation.

Alternatively, the process of correcting the driving profile PF so as to increase the transport time at the speed V2 may reduce the difference in speed between the table 20 and the chain 23, to thereby eliminate the lag of the coupling pin 37 behind the chain coupling portion 36. Table 2 shows an example of the speed calculation table used in such a case.

TABLE 2

| P1 (Encoder Pulses) | Transport Time at V2 (sec) |
|---|---|
| 20000 | 0.5 |
| 20010 | 0.5025 |
| 20020 | 0.505 |
| 20030 | 0.5075 |

The values of the transport time at the speed V2 for the values of the measured pulse count P1 not shown in Table 2 are found by linear interpolation.

Thus, the elongated condition of the chain 23 is grasped by using the measured pulse count P1 each time the coupling pin 37 to be detected passes through the first sensor 38*a* and the second sensor 38*b* when the transport mechanism 3 is in operation. The linear motor mechanism 24 is used to transport the table 20 while the driving profile PF is corrected in accordance with the speed calculation table as shown in Tables 1 and 2. This prevents the coupling pin 37 of the chain 23 from coming in contact with the chain coupling portion 36 of the table 20 if the chain 23 is elongated. In other words, the transport of the table 20 by means of the linear motor mechanism 24 is prevented from being influenced by the delay or lag in the movement of the chain 23 resulting from the elongation of the chain 23 due to deterioration from aging.

As described above, the image recording apparatus 100 according to the second preferred embodiment grasps the elongated condition of the chain 23 by using the measured pulse count P1 to correct the driving profile of the table 20 by means of the linear motor mechanism 24 based on the measured pulse count P1 when the transport mechanism 3 is in operation. This accomplishes the transport of the table 20 by means of the linear motor mechanism 24 well if the chain 23 is elongated.

<Modifications>

In the first preferred embodiment mentioned above, the driving speed value Vc of the chain 23 is determined in accordance with the arithmetic expression. Instead, the driving speed value Vc of the chain 23 may be determined based on a predetermined speed calculation table in a manner similar to that in the second preferred embodiment. On the other hand, the speed V2 may be determined from a predetermined arithmetic expression in the second preferred embodiment.

Further, the correction of the chain driving speed as described in the first preferred embodiment and the correction of the driving profile as described in the second preferred embodiment may be performed at the same time.

The transport mechanism 3 for the image recording apparatus 100 is described in the above-mentioned preferred embodiments. However, the transport mechanism to which the present invention is applicable is not limited to that for the image recording apparatus. The correction of the chain driving speed and the correction of the driving profile in the first and second preferred embodiments are applicable even when the transport mechanism is used for other than the image recording apparatus.

While the invention has been described in detail, the foregoing description is in all aspects illustrative and not restrictive. It is understood that numerous other modifications and variations can be devised without departing from the scope of the invention.

What is claimed is:

1. An image recording apparatus comprising:

a) a transport device for circularly transporting a holding table for holding a recording medium thereon, said transport device including a-1) a chain transport mechanism having a pair of rotary members, a chain looped around said pair of rotary members, and a chain driving mechanism for driving said pair of rotary members, said chain driving mechanism driving said pair of rotary members, with said holding table coupled to said chain by bringing a first coupling member provided on said chain into engagement with a second coupling member provided on said holding table, thereby transporting said holding table, a-2) a linear motor mechanism having a movable element coupled to said holding table and a stator extending in a direction in which said holding table travels, said linear motor mechanism changing the magnetic polarity of said stator to move said holding table, a-3) first and second transport sections, said first transport section being a section in which said chain transport mechanism transports said holding table in the entire transport section over which said holding table is transported, said second transport section being other than said first transport section included in the entire transport section and being a section in which said linear motor mechanism transports said holding table, said second transport section partly including an image recording section, said chain driving mechanism driving said pair of rotary members to move said chain even while said holding table is transported in said second transport section by means of said linear motor mechanism, said first coupling member being disengaged from said second coupling member when said holding table is transferred from said first transport section to said second transport section, said first coupling member being brought into engagement with said second coupling member again when said holding table is transferred from said second transport section to said first transport section, a-4) a first detection element for detecting said first coupling member starting passing through said second transport section during the transport of said holding table, a-5) a second detection element for detecting said first coupling member finishing passing through said second transport section during the transport of said holding table, a-6) a pulse counting element for starting counting driving pulses in response to a detection signal from said first detection element and finishing counting the driving pulses in response to a detection signal from said second detection element to thereby take a count of driving pulses obtained while said pair of rotary members are driven by said chain driving mechanism during the passage of said first coupling member through said second transport section, and a-7) a speed correction element for correcting a driving speed at which said pair of rotary members are driven by said chain driving mechanism in accordance with the elongated condition of said chain, based on said count of driving pulses so that a positional relationship between said first coupling member and said second coupling member relative to each other is held in said second transport section; and b) an image recording part for recording an image on said recording medium, said image recording part recording the image on said recording medium held on said holding table during the passage of said holding table through said image recording section.

2. The image recording apparatus according to claim 1, wherein:

said second coupling member has a generally triangular hole;

the engagement between said first coupling member and said second coupling member is achieved by bringing said first coupling member into engagement with said hole; and said speed correction element corrects the driving speed at which said pair of rotary members are driven by said chain driving mechanism so that said chain is moved, with said first coupling member held in a substantially middle position of said hole in said second transport section.

3. The image recording apparatus according to claim 1, wherein said transport device further includes:

a-8) a supply part for supplying said recording medium to said holding table upstream from said second transport section; and a-9) a discharge section for discharging said recording medium from said holding table past said second transport section.

4. A method of recording an image on a recording medium in an image recording apparatus, said method comprising the steps of:

a) causing a chain driving mechanism to drive a pair of rotary members around which a chain is looped, with a holding table coupled to said chain by bringing a first coupling member provided on said chain into engagement with a second coupling member provided on said holding table, thereby transporting said holding table in a first transport section;

b) transferring said holding table from said first transport section to a second transport section, said second transport section being other than said first transport section included in the entire transport section over which said holding table is transported, said first coupling member and said second coupling member being disengaged from each other when said holding table is transferred from said first transport section to said second transport section;

c) moving said holding table in said second transport section by means of a linear motor mechanism having a movable element coupled to said holding table and a stator extending in a direction in which said holding table travels, said linear motor mechanism changing the magnetic polarity of said stator to move said holding table, said chain driving mechanism driving said pair of rotary members to move said chain even while said holding table is transported in said second transport section by means of said linear motor mechanism;

d) recording the image on said recording medium held on said holding table, the image being recorded on said recording medium during the passage of said holding table through an image recording section provided partly in said second transport section;

e) transferring said holding table from said second transport section to said first transport section, said first coupling member disengaged from said second coupling member in said step b) being brought into engagement with said second coupling member again;

f) taking a count of driving pulses obtained while said pair of rotary members are driven by said chain driving mechanism during the passage of said first coupling member through said second transport section, the count of driving pulses being taken by starting counting the driving pulses in response to the detection of said first coupling member starting passing through said second transport section during the transport of said holding table and by finishing counting the driving pulses in response to the detection of said first coupling member finishing passing through said second transport section; and g) correcting a driving speed at which said pair of rotary members are driven by said chain driving mechanism in accordance with the elongated condition of said chain, said driving speed of said pair of rotary members being corrected based on said count of driving pulses so that a positional relationship between said first coupling member and said second coupling member relative to each other is held in said second transport section.

5. The method according to claim 4, wherein:

the engagement between said first coupling member and said second coupling member is achieved by bringing said first coupling member into engagement with a generally triangular hole formed in said second coupling member; and said driving speed at which said pair of rotary members are driven by said chain driving mechanism is corrected in said step g) so that said chain is moved, with said first coupling member held in a substantially middle position of said hole in said second transport section.

6. The method according to claim 4, further comprising the steps of:

h) supplying said recording medium to said holding table upstream from said second transport section; and i) discharging said recording medium from said holding table past said second transport section.

* * * * *